US006944890B1

(12) United States Patent
Sim

(10) Patent No.: US 6,944,890 B1
(45) Date of Patent: Sep. 20, 2005

(54) AUTOMATIC CLEANING ASSEMBLY FOR A TOILET BOWL

(76) Inventor: Jac K. Sim, 26 Brookstone, Irvine, CA (US) 92604

( * ) Notice: Subject to any disclaimer, the term of this patent is extended or adjusted under 35 U.S.C. 154(b) by 0 days.

(21) Appl. No.: 11/042,267

(22) Filed: Jan. 25, 2005

(51) Int. Cl.[7] ..... E03D 9/00
(52) U.S. Cl. ..... 4/225.1; 4/227.1; 4/227.4
(58) Field of Search ..... 4/225.1, 227.1, 4/227.4–227.6, 222–224

(56) References Cited

U.S. PATENT DOCUMENTS 4,312,082 A * 1/1982 Murphy et al. ..... 4/225.1
5,778,459 A * 7/1998 Guerin ..... 4/225.1
6,321,392 B1 11/2001 Sim
6,662,379 B2 12/2003 Nguyen et al.

* cited by examiner

*Primary Examiner*—Khoa D. Huynh
(74) *Attorney, Agent, or Firm*—Stetina Brunda Garred & Brucker

(57) ABSTRACT

Provided is a hydraulic time release system for regulating the flow of liquid therethrough. The time release system comprises a timer body having a timer inlet for providing liquid at a timer inlet flow rate and a timer outlet for discharging liquid at a timer outlet flow rate. The timer body is divided into a first reservoir, a second reservoir, a third reservoir and a float reservoir. The first reservoir includes a catch pan mounted on an open drain tube that is positioned below the timer inlet. The first, second and third reservoirs are in at least partial fluid communication with the float reservoir. A timer float assembly is moveable between open and closed positions in response to variations in the float reservoir liquid level. The closed position is such that the flow of liquid into the drain tube is blocked causing the timer body to fill with liquid whereupon the timer outlet flow rate is substantially equivalent to the timer inlet flow rate.

36 Claims, 8 Drawing Sheets

AUTOMATIC CLEANING ASSEMBLY FOR A TOILET BOWL

CROSS-REFERENCE TO RELATED APPLICATIONS

Not Applicable

STATEMENT RE: FEDERALLY SPONSORED RESEARCH/DEVELOPMENT

Not Applicable

BACKGROUND OF THE INVENTION

The present invention relates to a hydraulic timer mechanism and, more particularly, to a hydraulic time release system that is specifically adapted for delaying the flow of liquid therethrough. In addition, the hydraulic time release system is adapted for use with a cleaning assembly that may be attached to an inside wall of a toilet water holding tank of a toilet or urinal. When connected to the cleaning assembly, the time release system provides a time delay in the release of cleaning agent from the cleaning assembly such that the cleaning agent is retained within the toilet bowl after flushing of the toilet.

Included in the prior art are several systems which are designed to release cleaning agent into a toilet for maintaining a level of cleanliness thereof. One such prior art cleaning system comprises tablets or blocks of cleaning agent that may be placed in a tank or reservoir of the toilet. Over time, the cleaning agent dissolves in the water contained in the tank such that during flushing, cleaning agent solution is supplied to the toilet bowl. Unfortunately, such a system only allows for a limited time during which the cleaning agent is actually in contact with the toilet bowl because the toilet bowl eventually drains to the sewer and is refilled with water that does not contain any cleaning agent.

Another drawback associated with systems comprising cleaning agent tablets or blocks is that certain chemicals contained within the cleaning agent may have an adverse effect on certain parts of the toilet water holding tank. More specifically, non-metallic parts such as rubber or plastic parts contained within the toilet water holding tank may be subject to attack by chemicals of the cleaning agent. Over time, the proper sealing and function of such nonmetallic plastic and rubber parts may be compromised and may ultimately have an adverse effect on the proper operation of the toilet. A further drawback associated with cleaning agents in the form of tablets or blocks is that because the cleaning agent is always submerged within the toilet water holding tank, the useful life of the cleaning agent is relatively short such that the cleaning agent tablets or blocks must be periodically replaced.

In an attempt to overcome the above mentioned deficiencies associated with cleaning agents tablets or blocks, automatic cleaning agent dispensers have been developed for use with toilet bowls or urinal receptacles. For example, U.S. Pat. No. 6,321,392, (hereinafter the '392 reference), discloses an automatic cleaning assembly for a toilet bowl. The automatic cleaning assembly of the '392 reference includes a body member having an interior cavity for receiving the cleaning agent. The body member is attachable to a wall of the toilet water holding tank and includes an assembly inlet in fluid communication with a ball cock of the toilet and an assembly outlet in fluid communication with an overflow pipe of the toilet.

The '392 reference includes a removable cap that forms a sealed space of the body member wherein cleaning agent may be inserted. The cleaning agent slowly dissolves in liquid that flows into the interior cavity from the assembly inlet. The cleaning agent solution exits the assembly outlet into the overflow pipe of the toilet. Because the cleaning agent is contained within the interior cavity, excessive dissolving of the cleaning agent is avoided thereby prolonging the useful life of the cleaning agent. In addition, by containing the cleaning agent within the interior cavity of the body member instead of dissolving the cleaning agent in the toilet water holding tank, degradation of certain nonmetallic parts within the toilet water holding tank may be avoided.

Although the automatic cleaning assembly of the '392 reference provides advantages in an increase in the useful life of the cleaning agent as well as a prevention of degradation to certain nonmetallic components contained within the toilet water holding tank, the device of the '392 reference suffers from certain deficiencies that detract from its overall utility. More specifically, the discharge of the cleaning agent from the body member occurs simultaneous with the flushing of the toilet. During flushing, water from the ball cock enters the body member and contacts and dissolves the cleaning agent contained therewithin.

A highly concentrated solution of water and dissolved cleaning agent is created within the body member. The highly concentrated cleaning agent solution then flows into the overflow pipe and is delivered to the toilet bowl during the flushing. Unfortunately, the cleaning agent solution only contacts inner surfaces of the toilet bowl for a very short period of time during the initial stages of the flushing of the toilet. This is due to the fact that most of the highly concentrated cleaning agent solution drains out of the toilet bowl during the first few seconds after the toilet has been flushed. Unfortunately, only a diluted mixture of cleaning agent solution remains in the toilet bowl which reduces the overall effectiveness of the cleaning agent in maintaining the cleanliness of the toilet bowl.

As can be seen, there exists a need in the art for a hydraulic time release system that may be used in conjunction with an automatic cleaning assembly for a toilet bowl. In addition, there exists a need in the art for a hydraulic time release system that delays the release of cleaning agent solution from the automatic cleaning assembly such that highly concentrated cleaning agent solution is released into the toilet bowl only at the very end of each flush cycle and is not flushed to the sewer. Furthermore, there exists a need in the art for a hydraulic time release system that is of simple construction and with a minimal number of parts in order to minimize manufacturing and assembly costs. Finally, there exists a need in the art for a hydraulic time release system that is configured to minimize the escape of gases resulting from dissolution action of the cleaning agent in the water within the automatic cleaning assembly.

BRIEF SUMMARY OF THE INVENTION

Provided is a hydraulic time release system for delaying the flow of liquid therethrough in order to provide a delay of a release of cleaning agent for maintaining a level of cleanliness in an automatic cleaning assembly for a toilet or a urinal. The hydraulic time release system includes a timer body and is configured such that liquid entering the time release system at a timer inlet flow rate must substantially fill the timer body before the liquid exits the timer body at a flow rate that is substantially equivalent to the timer inlet flow rate. Such delay in the release of liquid from the timer body in turn causes a delay in the release of a solution of cleaning agent from the automatic cleaning system to the toilet bowl in order to ensure that cleaning agent solution remains in the bowl after each flushing cycle.

The hydraulic time release system comprises the timer body having a timer float assembly disposed therewithin. A timer inlet provides liquid to the timer body at the timer inlet flow rate. A timer outlet discharges liquid from the timer body at the timer outlet flow rate. The timer body may be divided into a first reservoir, a second reservoir, a third reservoir, and a float reservoir. The first reservoir includes a catch pan which may be mounted on an open drain tube protruding upwardly from a floor panel of the timer body. The drain tube opens to the exterior of the timer body such that when the float assembly is positioned in an open position, liquid entering the timer inlet generally passes into the drain tube and exits the timer body.

The first reservoir, second reservoir, and third reservoirs are each in at least partial fluid communication with another and with the float reservoir. The first reservoir is separated from the second reservoir by a first partition. The third reservoir is separated from the second reservoir by a second partition. The timer outlet is disposed in an exterior wall of the timer body at a location adjacent to the second reservoir. The first partition and second partition define the second reservoir. The first partition is configured to prevent rapid draining of the first reservoir during siphoning action created by flushing of the toilet so that a certain amount of liquid remains in the first reservoir after flushing. The second partition is configured to prevent draining of the second reservoir through a bleed valve that is located within the third reservoir so that, after each flush, the liquid remaining in the first reservoir flows into the second reservoir through a passageway.

The passageway, located at a lower portion of the first partition, allows liquid to flow from the first reservoir into the second reservoir at a relatively low flow rate. The passageway is sized and configured such that the rate at which liquid passes from the first reservoir to the second reservoir is less than the rate at which cleaning agent solution is released from the cleaning assembly. Such release of cleaning agent solution occurs during each flush of the toilet. Due to the relatively low liquid flow rate from the first reservoir to the second reservoir, the siphoning effect caused by flushing (and which would otherwise drain the timer body) ceases prior to completion of the draining of the first reservoir into the second reservoir. In this manner, liquid entering the second reservoir will rise to a level above that of the timer outlet such that the timer outlet remains submerged in liquid after each flush cycle. Because the timer outlet is submerged, cleaning agent gases that are generated within the cleaning assembly are prevented from flowing back into the timer body wherein the gas may otherwise be released to the environment through the check valve.

BRIEF DESCRIPTION OF THE DRAWINGS

These as well as other features of the present invention will become more apparent upon reference to the drawings wherein.

DETAILED DESCRIPTION OF THE INVENTION

Figure 1:
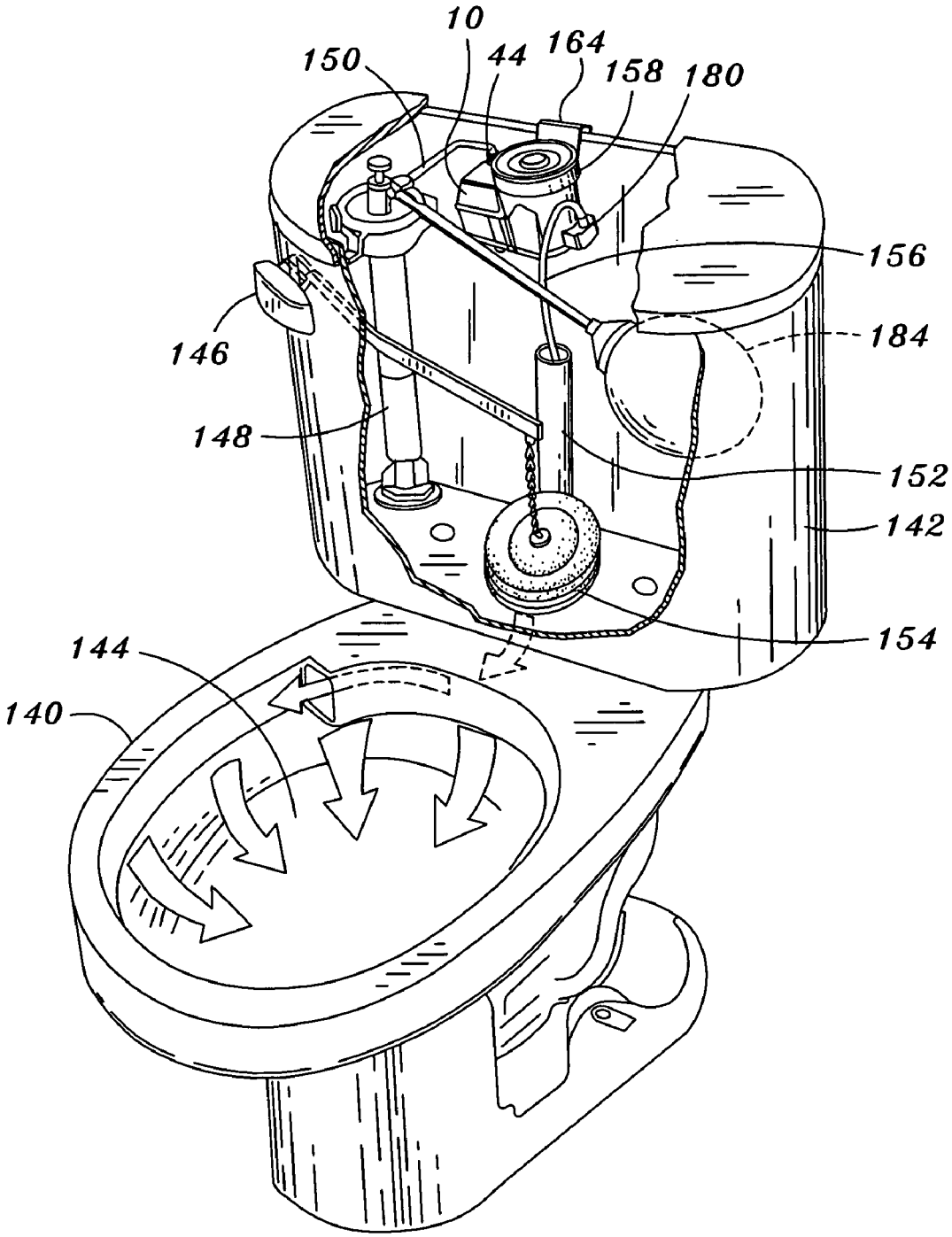
FIG. 1 is a perspective view of a toilet and illustrating a hydraulic time release system of the present invention and an automatic cleaning assembly which may be connectable thereto for installation within a toiler water holding tank of the toilet.

Referring now to the drawings wherein the showings are for purposes of illustrating various aspects of the invention and not for purposes of limiting the same, provided is a uniquely configured hydraulic time release system 10 specifically adapted for regulating the flow of liquid therethrough and which is operative to provide a time delay for the release of cleaning agent 174 such as may be used in an automatic cleaning assembly 158 for a toilet 140 or a urinal. The time release system 10 may be specifically adapted to be connectable to the automatic cleaning system 158 although it is contemplated that the time release system 10 may be used in conjunction with other fluidic devices requiring a delay in the release of fluid therefrom.

Referring now to FIGS. 1–12, shown is the hydraulic time release system 10 of the present invention as may be connectable to the automatic cleaning assembly 158 and which may be installed within a toilet water holding tank 142 of the toilet 140. As was earlier mentioned, the hydraulic time release system 10 is specifically configured to provide a time delay in the release of liquid therefrom. More particularly, the hydraulic time release system 10 is configured such that liquid entering a timer inlet 44 of a timer body 12 of the time release system 10 at a timer inlet 44 flow rate must substantially fill the timer body 12 whereupon the liquid exits a timer outlet 68 at a flow rate that is substantially equivalent to the timer inlet 44 flow rate.

When connected with the automatic cleaning assembly 158, the hydraulic time release system 10 causes a delay in the time from which a toilet 140 is flushed (which starts the flow of liquid to the timer body 12 at the timer inlet 44), to the time at which liquid flows out of the timer outlet 68 at the timer outlet 68 flow rate prior to entering the automatic cleaning system containing cleaning agent 174 therewithin. Such delay in the release of cleaning agent 174 solution from the automatic cleaning system ensures that cleaning agent 174 solution is supplied to the bowl only at the end of the flushing cycle. In this manner, cleaning agent 174 solution remains in the toilet bowl 144 following the flush of the toilet bowl 144 for more effective cleaning.

Figure 8:
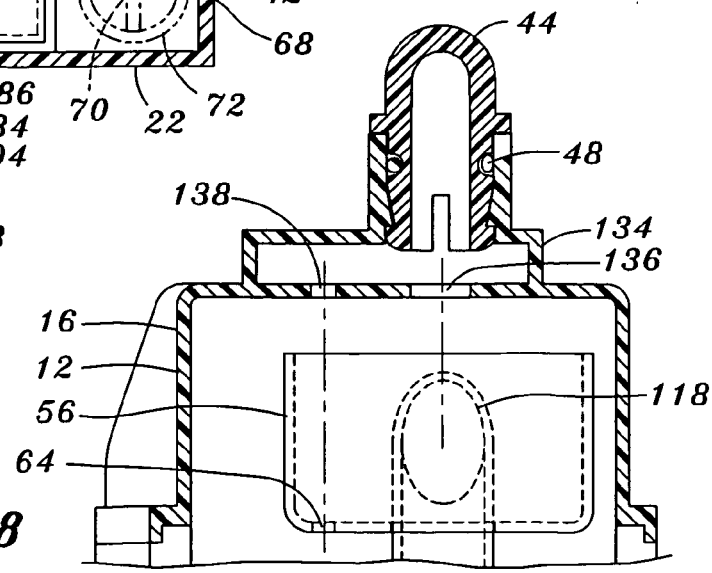
FIG. 8 is a front sectional view of the timer body taken along line 8—8 of FIG. 7 and illustrating the timer inlet having an inlet divider with first and second inlet ports.

In its broadest sense, the hydraulic time release system 10 comprises the timer body 12 having a timer float assembly 98 disposed therewithin. The timer body 12 has the timer inlet 44 for providing liquid to the timer body 12 at the timer inlet 44 flow rate. The timer body 12 also comprises the timer outlet 68 for discharging liquid from the timer body 12 at the timer outlet 68 flow rate. Importantly, the timer inlet 44 may include an inlet divider 134 having a first inlet port 136 and a second inlet port 138, as shown in FIG. 8. The first inlet port 136 is preferably sized and configured to provide liquid to the timer body 12 at a higher flow rate than that which is provided by the second inlet port 138. More specifically, the first inlet port 136 is generally larger in size than the second inlet port 138. As will be described in greater detail below, the first inlet port 136 is located such that during the initial stages of a flush cycle, a substantial portion of the liquid (e.g., about 99 percent of the liquid) entering the timer body 12 generally passes through and exits the timer body 12 through an open drain tube 118 that is generally aligned with the first inlet port 136. However, the remaining portion of the liquid (e.g., about one percent of the liquid), enters the timer body 12 through the second inlet port 138.

Figure 9:
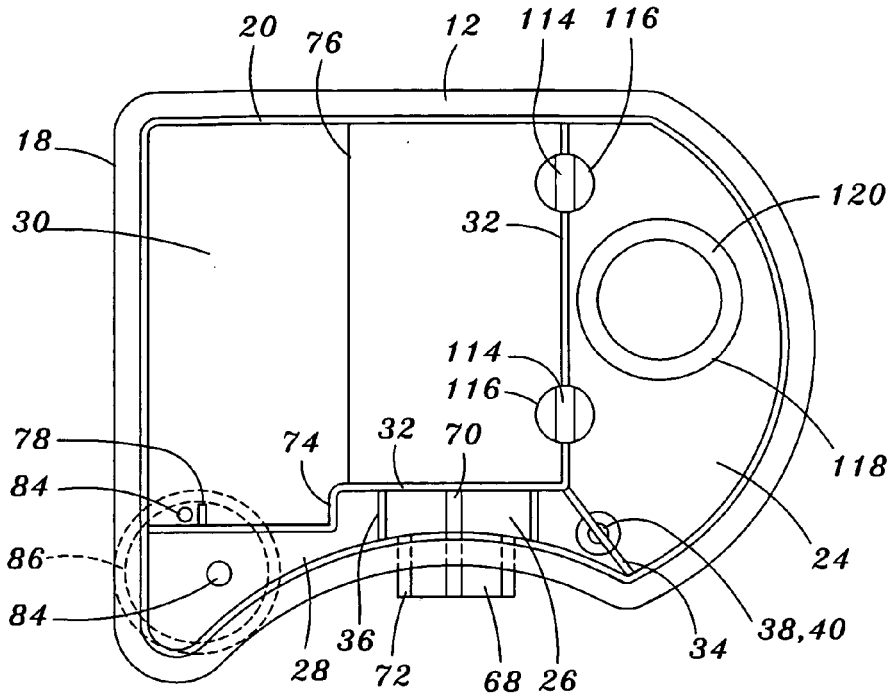
FIG. 9 is a top view of a lower body portion of the timer body taken along line 9—9 of FIG. 5 and illustrating the arrangement of first, second and third reservoirs and a float reservoir of the timer body.
Figure 10:
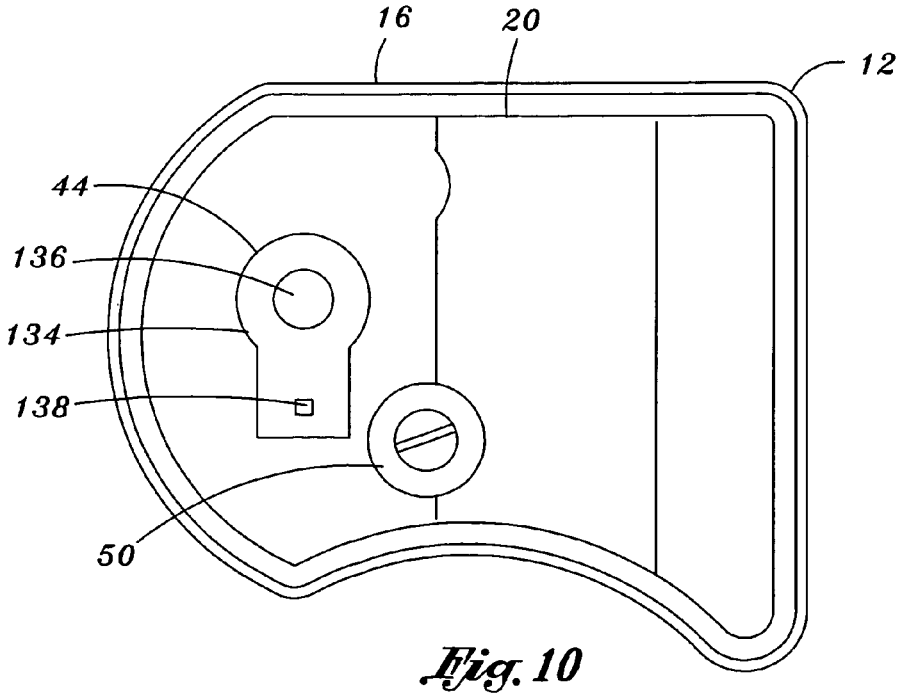
FIG. 10 is a bottom view of an upper body portion of the timer body taken along line 10—10 of FIG. 5 and illustrating the arrangement of the timer inlet and the check valve.

As can be seen by reference to FIGS. 3–6, the timer body 12 may be divided into a plurality of reservoirs. Each of the reservoirs may be arranged to be in at least partial fluid communication with one another. The time release system 10 may be configured such that the timer body 12 includes a quantity of reservoirs necessary to provide the desired duration of time delay for the time release system 10. For example, the timer body 12 may be configured to include only two or three reservoirs or the timer body 12 may include additional reservoirs. In addition, the size and configuration of the reservoirs may be adjusted to effect the desired duration of the time delay. More specifically, the overall volume occupied by each reservoir is directly correlated to the duration of time delay provided by the time release system 10. However, the time release system 10 may preferably be configured to have a first reservoir 24, a second reservoir 26, a third reservoir 28, and a float reservoir 30 as is shown in FIG. 9. The timer body 12 defines a body chamber 14 within which the first, second, third and float reservoirs 24, 26, 28, 30 are arranged.

Optionally, at least one of the reservoirs, such as the first reservoir 24, may include a catch pan 56 which may be supported or mounted on the open drain tube 118 which has a lower end 132 and an upper rim 120. The lower end 132 of the drain tube 118 may be connected to the floor panel 22 such that the drain tube 118 extends upwardly from the floor panel 22 of the timer body 12. The upper rim 120 of the drain tube 118 is preferably located beneath and in spaced relation to the first inlet port 136 of the timer inlet 44. The floor panel 22 of the timer body 12 serves as a bottom wall for the reservoirs which may comprise the first, second, third and float reservoirs 24, 26, 28, 30.

The timer body 12 also includes an exterior wall 20 which, in conjunction with the floor panel 22, extends around and encloses the timer body 12. As shown in FIGS. 3–10, the timer body 12 may be configured as a generally rectangular shape optionally having one or more curved sides such as at an interface of the exterior wall 20 of the timer body 12 with the cleaning assembly 158. However, it is contemplated that the timer body 12 may be configured in a wide variety of shapes and configurations suitable for providing the necessary flow characteristics between the first, second, third and float reservoirs 24, 26, 28, 30 as well as compatibility of fitment between the time release system 10 and other fluidic devices.

Figures 5, 5A:
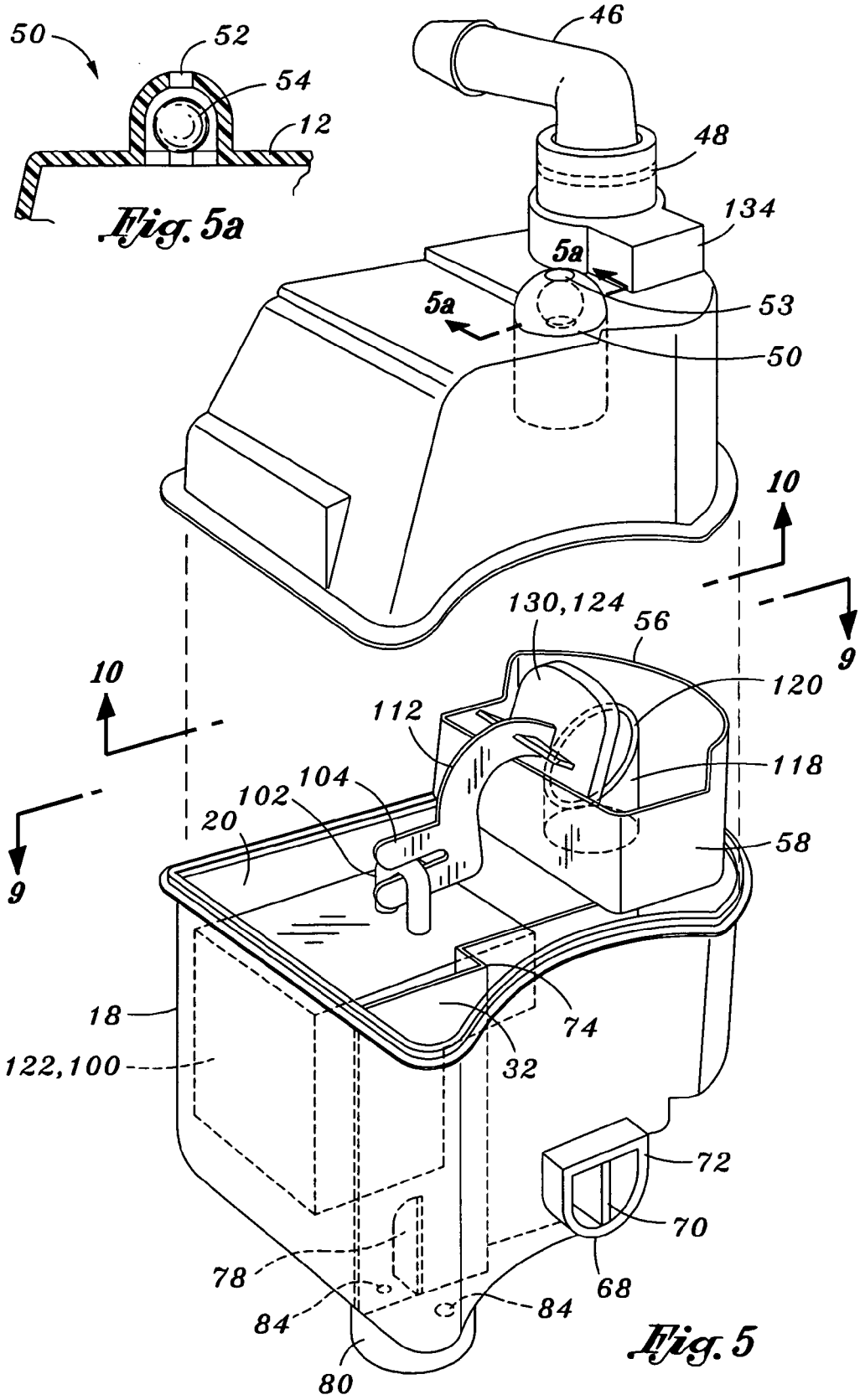
FIG. 5 is a partially exploded perspective view of the time release system illustrating an upper body portion and a lower body portion that make up a timer body of the time release system.

As shown in FIG. 5, the timer body 12 may include a lower body portion 18 and an upper body portion 16 which may collectively define and enclose the body chamber 14. The lower body portion 18 may be secured to the upper body portion 16 following assembly of the various components of the time release system 10. However, the upper and lower body portions 16, 18 may be configured to be releasably attached to one another in order to provide a means for inspecting and/or maintaining the time release system 10. Also shown in FIG. 5*a* is a check valve 50 which may be disposed in the upper body portion 16 of the timer body 12. As will be described in greater detail below, the check valve 50 is configured to prevent liquid and gas from flowing out of the body chamber 14 during operation of the time release system 10.

Figure 7:
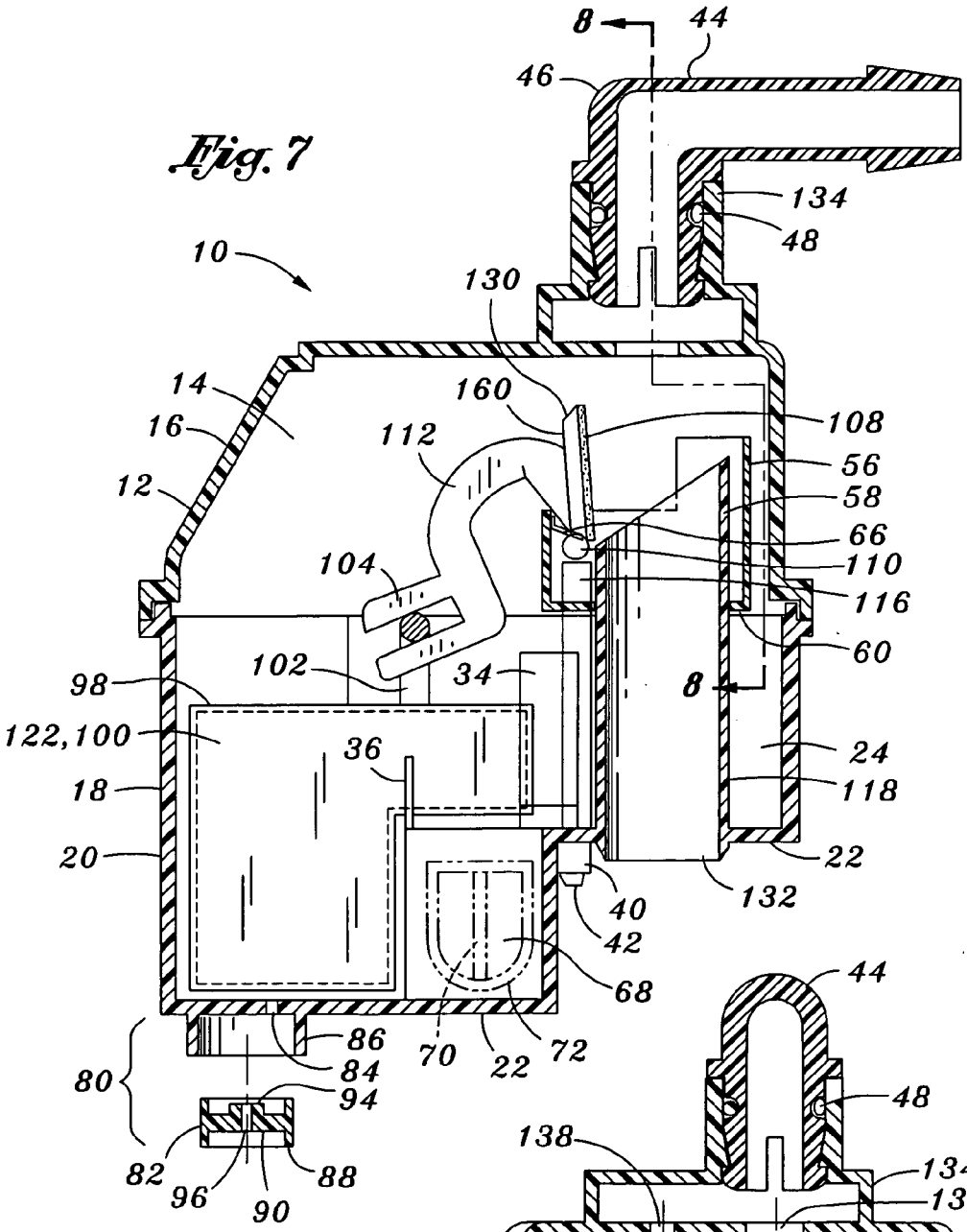
FIG. 7 is a side view of a timer body of the time release system illustrating a timer inlet and a timer outlet for respectively providing liquid to and discharging liquid from the timer body.

As was earlier mentioned, one of the reservoirs, such as, for example, the first reservoir 24, may include a catch pan 56 which is supported on the drain tube 118 which extends upwardly from the floor panel 22 of the first reservoir 24. As can be seen in FIG. 7, the drain tube 118 may be generally vertically oriented although other orientations are possible. The drain tube 118 is generally positioned below the timer inlet 44 of the timer body 12. The drain tube 118 extends from the floor panel 22 and opens to the exterior of the timer body 12 such that when the float assembly 98 is positioned in an open position 124, liquid entering the timer inlet 44 generally passes through the first inlet port 136 and enters the drain tube 118. The liquid then exits the timer body 12. The drain tube 118 may be of a generally cylindrical tubular configuration and may be integrally formed with the timer body 12 or the drain tube 118 may be a separate component. However, the drain tube 118 may be configured in any variety of shapes other than the cylindrical shape shown.

Figures 6, 6A:
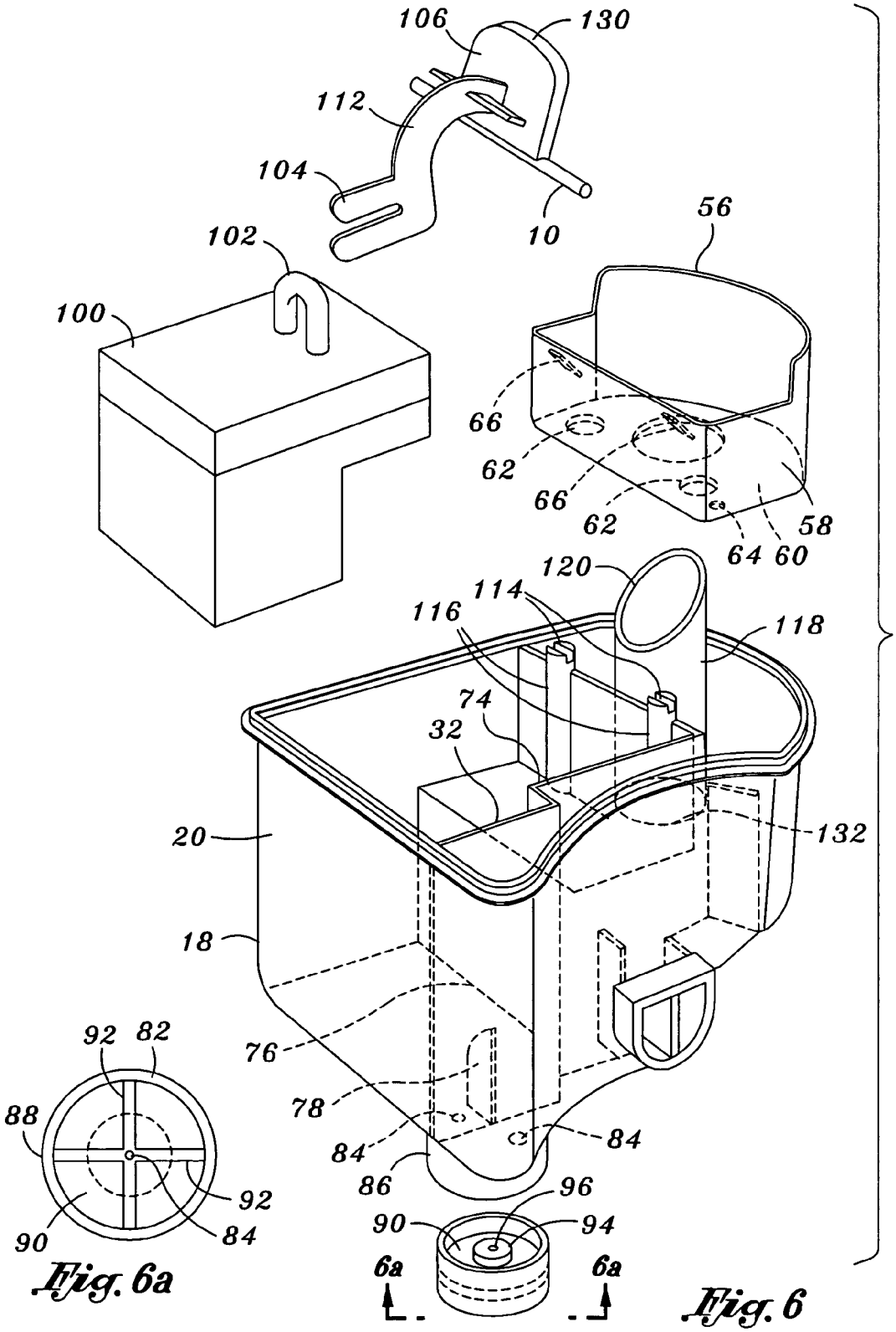
FIG. 6 is an exploded perspective view of the time release system illustrating the float assembly, a catch pan and a bleed valve assembly that may be included with the time release system.
FIG. 6*a* is a partial cross sectional view of the upper body portion of the timer body taken along lines 6*a*—6*a* of FIG. 6 and illustrating a check valve which may be disposed on the upper body portion.

The upper rim 120 of the drain tube 118 is shown in FIG. 6 as being slanted or disposed at an angle such that the timer float assembly 98 may directly engage the drain tube 118. Optionally, the time release system 10 may include the catch pan 56. However, the catch pan 56 may be altogether omitted such that liquid from the timer inlet 44 falls directly into one of the reservoirs such as the first reservoir 24. An alternative arrangement is that the catch pan 56 is configured as a plate having a hole formed therein through which liquid from the second inlet port 138 may pass.

If included with the time release system 10, the catch pan 56 may be mounted on the drain tube 118 such that the drain tube 118 extends upwardly through a catch pan bottom wall 60. The catch pan 56 also includes a catch pan side wall 58 which, in combination with the catch pan bottom wall 60, collectively encloses the catch pan 56. The catch pan 56 includes a catch pan orifice 64 to allow liquid from the second inlet port 138 to pass into the reservoir below. In addition, the catch pan orifice 64 allows for draining of liquid that has accumulated within the catch pan 56. Although shown in FIG. 5 as having a generally rectangular shape with one side having a generally arcuate shape to match the timer body 12, it is contemplated that the catch pan 56 may be configured in a wide variety of shapes, sizes and configurations suitable for collecting liquid from the timer inlet 44 in a manner which will be described in more detail below.

Referring to FIGS. 5, 7 and 8, the timer inlet 44 may include an inlet elbow 46 which may be connected to a fitting mounted on the timer body 12. The inlet elbow 46 may be removably secured to the fitting and may be sealingly engaged thereto utilizing an O-ring 48 between the fitting and the inlet elbow 46. Although the timer inlet 44 is shown as having an inlet elbow 46, it is contemplated that any number of configurations and fittings with different shapes and sizes may be utilized for the timer inlet 44. As was earlier mentioned, the timer inlet 44 includes the inlet divider 134 comprising the first inlet port 136 and the second inlet port 138. The first inlet port 136 is preferably positioned so as to be generally aligned with the drain tube 118.

In this manner, a substantial portion of liquid flowing from the first inlet port 136 into the body chamber 14 may flow through the drain tube 118 and exit the timer body 12 when the float assembly 98 is in the open position 124. However, the remaining portion of the liquid entering the timer body 12 at the second inlet port 138 may pass through the catch pan orifice 64 and collect within the reservoir, such as the first reservoir 24, that is located below the catch pan orifice 64. The second inlet port 138 may be generally aligned with the catch pan orifice 64 in order to facilitate direct flowing of liquid therebetween. Likewise, the fist inlet port if preferably aligned with the drain tube 118 to facilitate passage of fluid therebetween. The inlet divider 134 may be generally disposed on an upper portion of the timer body 12 as shown in FIG. 5. The inlet divider 134 comprises a generally rectangular housing which may be integrally molded with the timer body 12 or it may be a separate component joined to the timer body 12. The first and second inlet ports, 136, 138 may simply comprise separate apertures formed in the timer body 12. For example, the first inlet port 136 may be formed as a circular aperture while the second inlet port 138 may be formed as a relatively small rectangularly shaped aperture.

Referring still to FIG. 9, included with the timer body 12 are the first reservoir 24, the second reservoir 26, and the third reservoir 28 which are in fluid communication with the float reservoir 30. In addition, the second reservoir 26 is in at least partial fluid communication with the first reservoir 24. Likewise, the third reservoir 28 is in at least partial fluid communication with the second reservoir 26. As can be seen in FIG. 5, the timer outlet 68 is disposed in the exterior wall 20 of the timer body 12 at a location adjacent to the second reservoir 26. As can be seen, the first reservoir 24 is separated from the second reservoir 26 by a first partition 34. The third reservoir 28 is separated from the second reservoir 26 by a second partition 36. It is also contemplated that the timer body 12 may include additional reservoirs with additional partitions partially separating the reservoirs. For example, the timer body 12 may include a fourth reservoir that may be separated from other reservoirs by a third partition.

Preferably, a first partition 34 and a second partition 36 are each configured to prevent draining of the second reservoir 26 during siphoning action created by emptying of the interior cavity 162 of the cleaning assembly 158 during the release of the cleaning agent 174 therefrom into the toilet bowl 144. As will be described in greater detail below, such siphoning action occurs during flushing of the toilet 140. Importantly, the first partition 34 includes at least one passageway 38 formed at a lower portion thereof and which is configured to allow for fluid communication between the first and second reservoirs 24, 26 at a relatively low flow rate. Additional passageways may be provided to fluidly connect the first reservoir 24 to the second reservoir 26 at a lower portion therebetween. The passageway 38 is preferably sized and configured such that the rate at which liquid passes from the first reservoir 24 to the second reservoir 26 is greater than the rate at which liquid exits the assembly outlet 180 of the cleaning assembly 158 during flushing of the toilet 140.

In this manner, such low rate of liquid flow between the first reservoir 24 and the second reservoir 26 allows a level of liquid within the interior cavity 162 of the cleaning assembly 158 to remain at a height above the assembly inlet 178 of the cleaning assembly 158 after flushing the toilet 140. In other words, the timer release system is configured such that after each flush cycle and after the cleaning agent 174 solution within the cleaning assembly 158 is released to the toilet bowl 144, the assembly inlet 178 and the timer outlet 68 are both submerged in liquid. Importantly, maintaining such a level of liquid in the second reservoir 26 prevents the outflow of chlorine gas or other gas which may be generated by the creation of the cleaning agent 174 solution within the cleaning assembly 158. Such release of gas is undesirable in that it may result in unpleasant odors escaping into the toilet water holding tank 142 and eventually into the bathroom or other facility where the toilet 140 may be located.

Referring still to FIG. 9, the passageway 38 may be configured as a bore 40 formed completely or at least partially through the floor panel 22 of the timer body 12. As is shown in FIG. 9, the bore 40 may be located directly below the first partition 34 such that a portion of the bore 40 fluidly connects the first reservoir 24 to the second reservoir 26. In this manner, liquid may pass from the first reservoir 24, through the bore 40 underneath the first partition 34, and into the second reservoir 26. It is contemplated that the passageway 38, which is configured as the bore 40, may further include an externally accessible plug 42 which may be inserted into the bore 40 from the exterior of the floor panel 22 such that liquid may not escape through the bore 40 to the exterior of the timer body 12.

However, it is contemplated that the passageway 38 may be configured in a variety of alternative embodiments including, but not limited to, a small hole formed in a lower portion of the first partition 34. As can be seen in FIG. 7, the first partition 34 is generally configured to be at a height that is above that of the second partition 36. As may be appreciated, the various volumes occupied by the first, second and third reservoirs, 24, 26, 28 as well as the volume occupied by the float reservoir 30 directly corresponds to the duration of time delay between the time of initial liquid flow into the timer body 12 and the time at which the timer body 12 is completely filled with liquid whereupon such liquid is discharged out of the timer outlet 68 at a rate equivalent to that of the timer inlet 44 flow rate.

Figure 4:
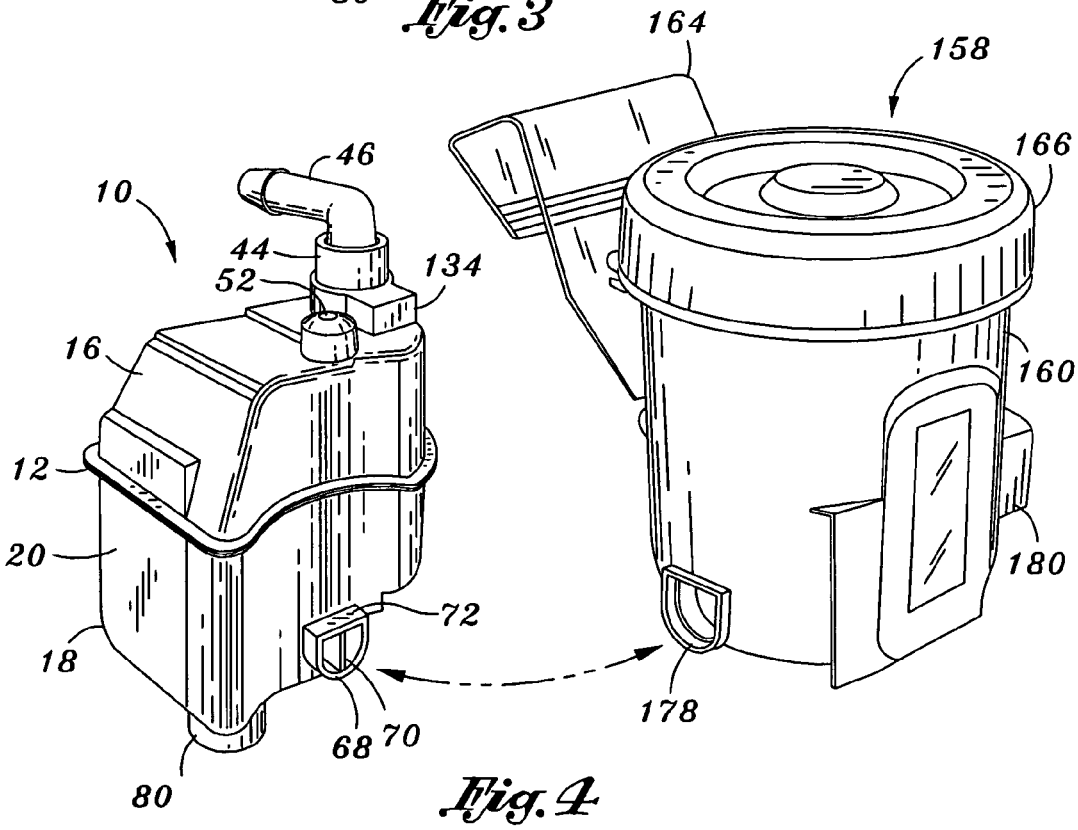
FIG. 4 is a perspective view of the time release system illustrating the interconnectivity thereof to the cleaning assembly.

Referring now to FIG. 5, as was earlier mentioned, the timer outlet 68 is disposed in the exterior wall 20 adjacent the second partition 36. In addition, the timer outlet 68 is preferably disposed at a lower portion of the second reservoir 26 as shown in FIGS. 4–5. The timer outlet 68 may include an outlet flange 72 extending laterally outwardly from the exterior wall 20 around an opening 52 of the timer outlet 68. The shape of the outlet flange 72 may be configured to be complimentary to the shape of the assembly inlet 178 of the cleaning assembly 158 to which the time release system 10 may be releasably secured. The timer outlet 68 may further include an outlet rib 70 formed in a central portion of the timer outlet 68.

Being generally vertically oriented and extending between upper and lower ends of the timer outlet 68, the outlet rib 70 may provide structural reinforcement to the timer outlet 68. As can be seen in FIG. 5, the outlet rib 70 may extend inwardly from the timer outlet 68 and be secured to a main interior wall 32 that separates the flow reservoir from the first, second and third reservoirs, 24, 26, 28. As shown in FIG. 5, the outlet rib 70 may be preferably integrally formed with the timer body 12 during formation thereof. However, it is contemplated that the outlet rib 70 may be altogether excluded or may be provided in alternative shapes, sizes and configurations other than that which is shown in FIG. 5.

Referring still to FIGS. 5, 7 and 9, shown is the third reservoir 28 which is disposed between the exterior wall 20 and the float reservoir 30 and the second reservoir 26. As was earlier mentioned, the third reservoir 28 is in fluid communication with the float reservoir 30 and with the second reservoir 26. As shown in FIGS. 6–7, the timer body 12 may include a step 76 formed in the floor panel 22 thereof. The step 76 may also define one of opposing ends of the third reservoir 28. The step 76 may generally extend across the timer body 12 and provides a difference in elevation in the floor panel 22 of the timer body 12. As will be described in greater detail below, the float assembly 98 is configured to be complimentary to the shape of the timer body 12 and, more specifically, to the shape of the float reservoir 30 and third reservoir 28.

Also included with the timer body 12 is a bleed valve assembly 80 that is disposed adjacent the floor panel 22 of the timer body 12. As can be seen in FIGS. 6–7, the bleed valve assembly 80 is positioned below that portion of the main interior wall 32 which divides the float reservoir 30 from the first, second and third reservoirs, 24, 26, 28. The main interior wall 32 may include a joggle 74, as is shown in FIG. 9. By including the joggle 74 in the main interior wall 32, liquid may more readily drain from the float reservoir 30 while the float assembly 98 is at its lowest position. A bleed valve aperture 84 may be formed in each one of the float reservoir 30 and third reservoir 28 to allow liquid to drain from the float reservoir 30. The joggle 74 provides a space between the main interior wall 32 and the float member 100 in the lower position 122 to allow liquid to drain from the float reservoir 30. In this regard, the joggle 74 prevents any impedance in draining of the liquid that may be otherwise created by the float member 100 when it is in the lower position 122. In addition, a float guide rib 78 may be included with the main interior wall 32 and may extend upwardly from the floor panel 22. Beveled on its upper edge, the float guide rib 78 may guide the float assembly 98 in its reciprocative movement within the float reservoir 30.

Referring still to FIGS. 6–6*a*, a bleed valve aperture 84 may be included in each one of the float reservoir 30 and third reservoir 28 to allow liquid to drain therefrom. The bleed valve apertures 84 are shown as generally straddling the main interior wall 32 separating the float reservoir 30 from the third reservoir 28. However, the bleed valve apertures 84 may be provided in any number and may be located anywhere along the floor panel 22 of the timer body 12. As shown in FIGS. 6–6*a*, the bleed valve apertures 84 are generally located adjacent to one another. The bleed valve assembly 80 may include a bleed valve fence or bleed valve shoulder 86 extending downwardly from the floor panel 22 on an exterior side of the timer body 12. Although shown as being generally cylindrically or annularly shaped, the bleed valve shoulder 86 may be configured in a variety of alternative shapes. The bleed valve shoulder 86 may circumscribe the bleed valve apertures 84 in order to facilitate draining of the liquid due to the unique structural arrangement of the bleed valve assembly 80.

As will be described in greater detail below, the bleed valve assembly 80 is configured such that when the float valve 106 is in the closed position and the timer body 12 is subsequently filled with liquid, there is an increase in liquid pressure within the timer body 12 relative to the liquid pressure when the float valve 106 is in the open position 124. Under such increased liquid pressure, the bleed valve assembly 80 is configured to allow the liquid to flow out of the timer body 12 in a relatively small stream through a relatively small insert port 96 when the float valve 106 is in the closed position. Conversely, when the float valve 106 is in the open position 124, the pressure of liquid within the timer body 12 is reduced. The bleed valve assembly 80 is also configured to promote liquid droplet formation when the float valve 106 is in the open position 124 and the liquid is under such reduced pressure.

As can be seen in FIGS. 6–6*a*, the bleed valve assembly 80 may also include a valve insert 82 that is configured to be connectable to or insertable within the bleed valve shoulder 86. The valve insert 82 may comprise an insert web 90 which extends across an insert flange 88 of the valve insert 82. Also having a generally cylindrical shape that is complimentary to that of the bleed valve shoulder 86, the valve insert 82 is configured such that liquid droplet formation is promoted in order to facilitate drainage of the float reservoir 30 and third reservoir 28 when the float valve 106 is in the open position 124.

Toward this end, the valve insert 82 may include an insert boss 94 which may be formed on an upper surface of the insert web 90. Although shown as being generally disc-shaped or cylindrical and having a diameter that is relatively smaller than that of the bleed valve shoulder 86, the insert boss 94 may be provided in any number of shapes and sizes. Extending through the insert boss 94 and insert web 90 is the generally vertically oriented insert port 96 that may be generally located in the center of the bleed valve insert 82 and through which liquid from the third reservoir 28 and the float reservoir 30 may drain in either a stream form or in droplet form depending on the pressure within the timer body 12. As shown in FIGS. 6–6*a*, the insert flange 88 is preferably sized and configured to be complimentary to the bleed valve shoulder 86. In this manner, the valve insert 82 may be inserted into and frictionally engaged to the bleed valve shoulder 86.

Preferably, the valve insert 82 is sized and configured such that when installed in the bleed valve shoulder 86, the insert boss 94 is disposed in spaced relation to the exterior surface of the floor panel 22. In this manner, liquid droplet formation is promoted during draining of the third reservoir 28 and float reservoir 30 when the float valve 106 is in the open position 124. More specifically, the insert port 96, bleed valve shoulder 86 and insert flange 88 may each be sized and configured to cause the liquid to stream through the insert port 96 when the float valve 106 is in the closed position and to promote liquid droplet formation when the float valve 106 is in the open position 124. As a further measure to promote liquid droplet formation of the bleed valve assembly 80, the insert web 90 may include at least one elongate groove 92 formed in a lower surface of the insert web 90 opposite the insert boss 94. The groove 92 may span partially or completely across opposing sides of the insert flange 88 and may extend across the insert port 96.

Although shown as extending diametrically across a lower surface of the insert web 90, it is contemplated that the groove 92 may be provided in a variety of alternative arrangements and orientation but is preferably located on the lower surface of the insert flange 88. Furthermore, multiple ones of the grooves 92 may be formed on the lower surface of the insert web 90. For example, the valve insert 82 may include a pair of grooves 92 oriented at ninety-degrees relative to one another. As was earlier mentioned the bleed valve shoulder 86 is preferably annularly shaped and the insert flange 88 is preferably configured to be complimentary to the annular shape of the bleed valve shoulder 86 such that an outer surface of the valve insert 82 is readably engagable to an inner surface of the bleed valve shoulder 86.

Referring still to FIGS. 5–7, also included with the time release system 10 is the float assembly 98 which is disposed within the float reservoir 30. As can be seen, the float assembly 98 includes a generally buoyant and/or hollow float member 100 that is connected to a float valve 106 by a hinge arm 112. The hinge arm 112 may be pivotably supported on a pair of posts 116 that extend upwardly from the floor panel 22 of the timer body 12. The hinge arm 112 may be connected to the float member 100 by a bail 102 which may be disposed on an upper surface of the float member 100 and may be configured in an inverted "U" shape. The hinge arm 112 may also include a fork 104 formed on an end thereof which is engagable with the bail 102. The fork 104 may be configured to form a "U" shape on an end of the hinge arm 112 although various alternative configurations of the fork 104 are contemplated. The fork 104 allows the bail 102 to slide therewithin during vertical reciprocative movement of the float member 100 within the float reservoir 30.

The float member 100 itself is preferably shaped complimentary to the float reservoir 30. More specifically, the float reservoir 30 may include a step 76 to match a step 76 formed in the floor panel 22 of the timer body 12. The float member 100 may have a generally cubical configuration to match the generally rectangular shape of the float reservoir 30 as bounded by the exterior walls 20 and the main interior wall 32. Referring back to FIGS. 6–7, as can be seen, the float valve 106 is disposed on an end of the hinge arm 112 and is configured to be engagable to the upper rim 120 of the drain tube 118. More specifically, the float valve 106 includes the valve lid 130 which is disposed on an end of the hinge arm 112. The valve lid 130 is preferably shaped complementary to and is configured to sealingly engage the upper rim 120 of the drain tube 118 when the float member 100 is in the upper position. A gasket 108 maybe disposed on the underside of the valve lid 130 in order to facilitate sealing engagement thereof to the upper rim 120 of the drain tube 118, as will be described in greater detail below.

The hinge arm 112 is pivotably supported by a valve axle 110. As shown in FIGS. 6 and 9, notches 114 may be formed in each one of the posts 116 such that the valve axle 110 is pivotally carried thereon. A pair of fingers 66 extending outwardly from the main interior wall 32 may provide a means to retain the valve axle 110 within the notches 114. The fingers 66 and posts 116 may be formed integrally with that portion of the main interior wall 32 which separates the float reservoir 30 from the first reservoir 24. The posts 116 may also be oriented to extend upwardly from the floor panel 22 and beyond an upper edge of the main interior wall 32. The posts 116 may pass through a pair of post-receiving openings 62 that may be formed within the catch pan bottom wall 60. Alternatively, it is contemplated that the catch pan 56 may be configured such that the posts 116 do not pass therethrough.

As was earlier mentioned, the valve lid 130 may include the gasket 108 disposed on the underside thereof to facilitate sealing engagement of the valve lid 130 to the upper rim 120 of the drain tube 118. The gasket 108 may be formed of any suitable material capable of improving sealing engagement and may preferably be comprised of an elastomeric material such as silicone sheet material which may be secured to an underside of the valve lid 130 as shown in FIG. 7. However, the gasket 108 may be comprised of any material suitable for creating sealing engagement between the valve lid 130 and the upper rim 120 of the drain tube 118.

As may be appreciated, the float member 100 is configured to rise and fall in concert with the changing level of liquid within the float reservoir 30. More specifically, the float member 100 is configured to be reciprocatably movable within the float reservoir 30 in a generally vertical direction. As the float reservoir 30 collects liquid that overflows the main interior wall 32 from the first, second and third reservoirs, 24, 26, 28, the float member 100 will move up or down in accordance with changes in the liquid level which, in turn, causes the hinge arm 112 to pivot about the valve axle 110. The float member 100 therefore moves from a lower position 122 to an upper position as the liquid level rises in the float reservoir 30, and vice versa as the liquid level is reduced. Resultant pivoting of the hinge arm 112 about the valve axle 110 causes the float valve 106 to move from an open position 124 to a closed position. More specifically, the valve lid 130, which is disposed on an end of the hinge arm 112, move into and out of engagement with the upper rim 120 of the drain tube 118. In this regard, the float valve 106 is configured to be movable in response to variations in the float reservoir 30 liquid level caused by the flow of liquid between the first, second, third reservoirs 24, 26, 28, and the float reservoir 30.

The open position 124 of the float valve 106 is characterized by a substantial portion of liquid entering the timer body 12 through the first inlet port 136 of the timer inlet 44 and generally passing through the drain tube 118 and exiting the timer body 12. However, because of the unique configuration of the inlet divider 134, a remaining portion of the liquid enters the timer body 12 through the second inlet port 138. Such remaining portion of liquid does not enter the drain tube 118 but instead flows downwardly toward the catch pan 56, if included. The catch pan 56 includes the catch pan orifice 64 which may be generally aligned with the second inlet port 138. Liquid flows through the catch pan orifice 64 and into the first reservoir 24 located below the catch pan 56. As the liquid level in the first reservoir 24 rises, the liquid will successively flow over the first partition 34 and into the second reservoir 26. A small portion of such liquid will flow through the passageway 38 located at a lower portion of the first partition 34. The liquid will eventually fill the second reservoir 26 and flow over the second partition 36 into the third reservoir 28.

During this time, the rate of liquid flow out of the timer outlet 68 is substantially less than that of the liquid flow into the timer body 12 at the timer inlet 44 because a major portion of the liquid entering the timer inlet 44 at the first inlet port 136 passes through the drain tube 118 and exits the timer body 12. Initially, only a minor portion of the liquid entering the timer inlet 44 at the second inlet port 138 will accumulate in the timer body 12 to be subsequently discharged from the timer body 12 at the timer outlet 68. However, as liquid flows into the float reservoir 30 from the first, second, and third reservoirs, 24, 26, 28, the float member 100 rises which in turn moves the float valve 106 from the open position 124, shown in FIG. 7, to the closed position wherein the float valve 106 effectively closes off the drain tube 118 to prevent liquid from passing therethrough. In the closed position, a substantial portion of the liquid which would otherwise pass through the drain tube 118, now flows directly to the catch pan 56 which may already be filled with liquid flowing into the first reservoir 24.

At this point, a majority of liquid flowing into the timer body 12 at the timer inlet 44 generally falls into the first reservoir 24 with a portion spilling over into the float reservoir 30 and passing into the second and third reservoirs, 26, 28. At the same time, liquid continually flows between the first, second, third and float reservoirs 24, 26, 28, 30 resulting in filling of the float reservoirs 30 which causes the float member 100 to rise which pivots the valve lid 130 into engagement with the drain tube 118 wherein the float valve 106 is in the closed position. When the float valve 106 is in the closed position, the valve lid 130 then blocks the flow of substantially all liquid from the first inlet port 136 from passing into the drain tube 118. Therefore, such liquid will instead cause a rapid increase in the rate at which the timer body 12 fills with liquid.

The check valve 50 is shown in FIGS. 5 and 5*a* as being installed in an upper portion of the timer body 12. In response to liquid filling the timer body 12, the normally open check valve 50 moves into the closed position wherein a ball 54 of the check valve 50 blocks an opening 52 thereof. Once in the closed position, the check valve 50 blocks the flow of liquid out of the timer body 12. At this point, the pressure of liquid within the timer body 12 is increased and because the timer body 12 is full of liquid, substantially all of the liquid which enters the timer inlet 44 will now exit the timer outlet 68. Therefore, the timer outlet 68 flow rate will be substantially equivalent to the timer inlet 44 flow rate. Liquid from the timer outlet 68 then flows into the assembly inlet 178 of the cleaning assembly 158 which may be connected to the time release system 10.

Figure 2:
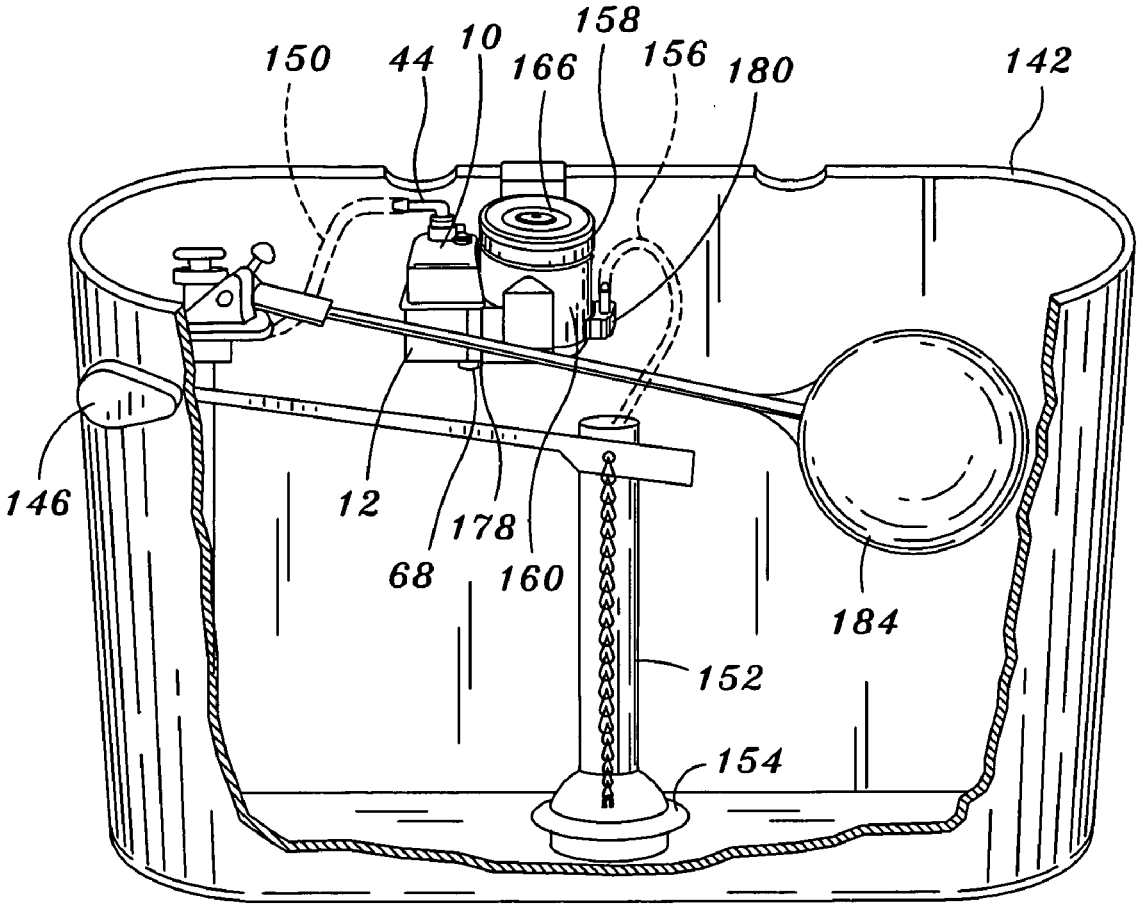
FIG. 2 is an enlarged perspective view of the time release system connected to the automatic cleaning assembly disposed within the water holding tank with cutaway portions to illustrate the interconnectivity of the time release system and cleaning assembly to a ball cock and a overflow pipe installed in the water holding tank.
Figure 3:
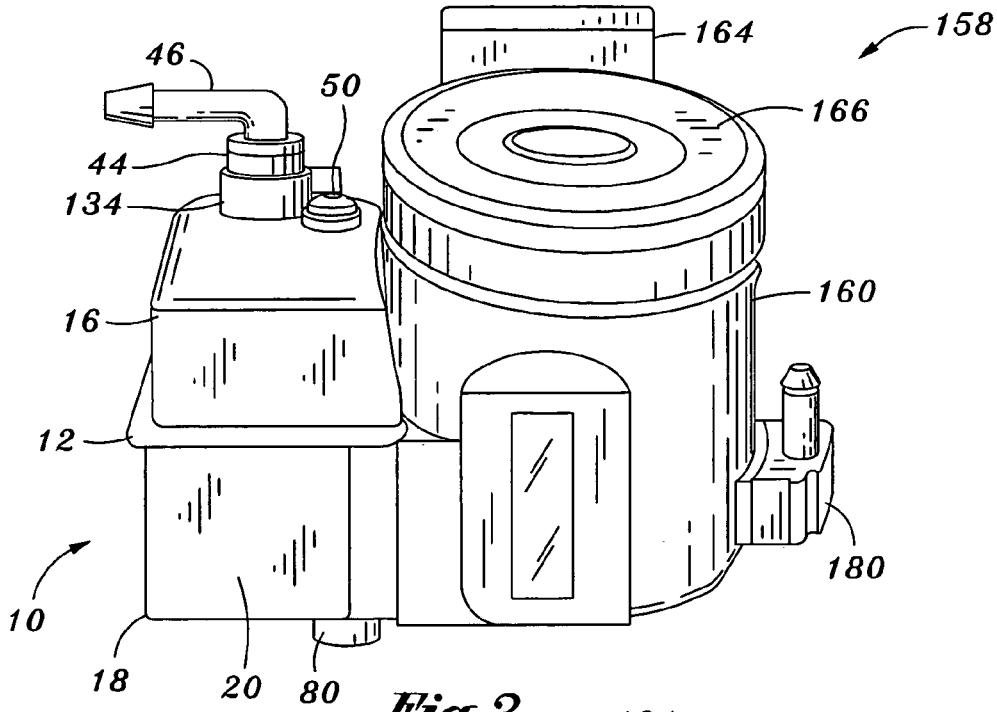
FIG. 3 is a perspective view of the time release system of the present invention.

As was earlier mentioned, the timer inlet 44 is configured to be fluidly connectable to a ball cock 148 of the toilet 140 as is shown in FIGS. 1 and 2. A refill tube 150 connects the ball cock 148 to the timer inlet 44. The timer outlet 68, as shown in FIGS. 4 and 5, is configured to be complimentary to and connectable with the assembly inlet 178, as shown in FIG. 4. FIG. 2 shows a connecting hose 156 which connects the assembly outlet 180 to an overflow pipe 152 of the toilet 140. However, it should be noted that the cleaning assembly 158 may be connected to other fluidic devices other than a toilet 140 and that other components may therefore by used to effectuate such connectivity between the cleaning assembly 158 and the fluidic device. Likewise, other components may be used to connect the time release system 10 to other fluidic devices other than the toilet 140.

The catch pan 56 and the first, second, third and float reservoirs 24, 26, 28, 30 are each sized and configured to provide a time delay for release of liquid from the timer body 12 at the timer outlet 68 at the same flow rate occurring at the timer inlet 44. The time delay is measured from the time at which fluid initially enters the timer inlet 44 to the time at which the timer inlet 44 flow rate is substantially equivalent to the timer outlet 68 flow rate. As provided in the configuration shown in FIGS. 1–12, the timer body 12, and, more specifically, the first, second, third and float reservoirs 24, 26, 28, 30 and the catch pan 56 are each sized and configured such that the time delay is in the range from about four seconds to about seven seconds. However, it should be noted that by adjusting the relative size and shapes of the first, second, third and float reservoirs 24, 26, 28, 30 and the catch pan 56 as well as the configuration of the float assembly 98, any range of time delay may be provided by the time release system 10.

It has been determined that a time delay in such range allows for flushing of the toilet bowl 144 prior to refilling of the toilet bowl 144 with cleaning agent 174 solution such that the cleaning agent 174 solution remains in the toilet bowl 144 without draining through the sewer. In this manner, the effectiveness of the cleaning agent 174 is substantially increased due to the cleaning agent 174 solution remaining within the toilet bowl 144 after flushing and not draining into the sewer along with the water from the water holding tank 142 during the flushing operation. More specifically, the time release system 10 provides a greater period of time in which the cleaning agent 174 solution is in contact with the toilet bowl 144.

Figure 11:
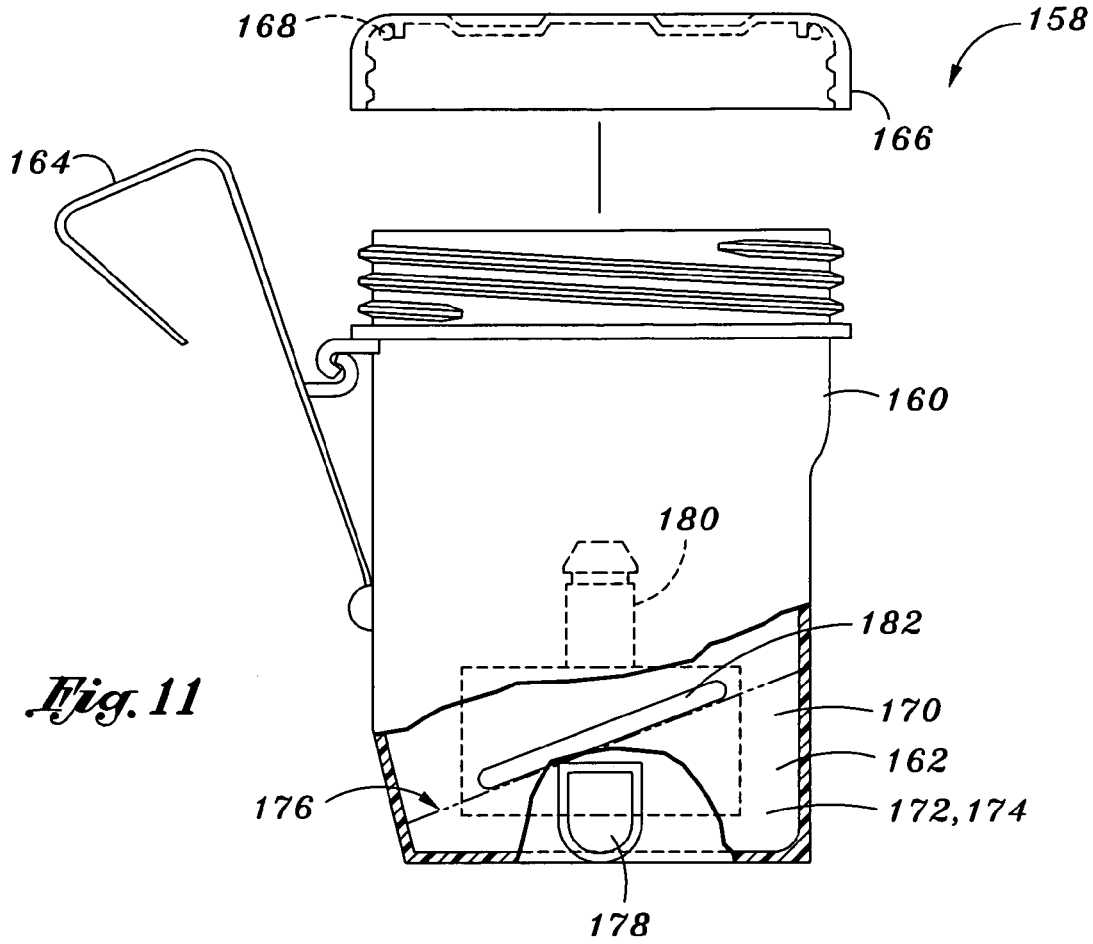
FIG. 11 is a partially cutaway side view of the cleaning assembly illustrating an assembly inlet of the cleaning assembly and further illustrating a slot formed in the body member adjacent to the assembly outlet.
Figure 12:
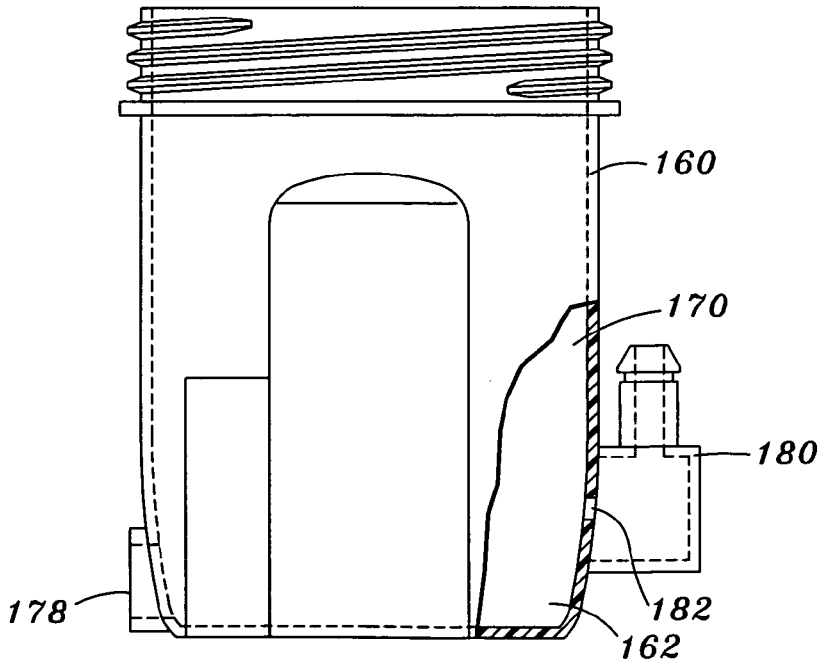
FIG. 12 is a front view of the cleaning assembly illustrating the elevational difference between an assembly inlet and the assembly outlet.

Referring now to FIGS. 11–12, shown is the cleaning assembly 158 to which the time release system 10 of the present invention may be connected. As can be seen, the cleaning assembly 158 includes a body member 160 having a sealed interior cavity 162 formed therewithin. The sealed interior cavity 162 defines an assembly interior 170 and which includes a cleaning agent holder 172 for receiving a cleaning agent 174 of a type that may be used for cleaning the toilet bowl 144. The cleaning assembly 158 shown in FIGS. 11–12 is similar in structure and function to that shown and disclosed in U.S. Pat. No. 6,321,392, the entire contents of which are herein incorporated by reference.

As shown in the '392 patent, the cleaning assembly 158 is configured to release the cleaning agent 174 solution into the toilet bowl 144 during flushing of the toilet 140. The cleaning assembly 158 includes the body member 160 having an assembly inlet 178 and an assembly outlet 180. The assembly inlet 178 is configured to be in fluid communication with the interior cavity 162 and is connectable to the timer outlet 68. The assembly outlet 180 is configured to be in fluid communication with the interior cavity 162 and is connectable to the pipe 152 of the toilet 140 via the connecting hose 156, as was earlier mentioned. Importantly, the body member 160 includes a slot 182 formed therethrough adjacent to the assembly outlet 180. The slot 182 is configured and arranged to allow cleaning agent 174 solution from the cleaning assembly 158 to pass therethrough prior to entering the connecting hose 156 and passing into the overflow pipe 152.

As shown in FIG. 11, the slot 182 is preferably positioned to be at a higher level than that of the assembly inlet 178. Such positioning of the slot 182 relative to the assembly inlet 178 ensures that a level of liquid within the interior cavity 162 remains above the assembly inlet 178 after flushing in order to prevent gas from the interior cavity 162 discharging out of the interior cavity 162 due to siphoning action generated by flushing of the toilet 140. Furthermore, it can be seen in FIG. 11 that the slot 182 is oriented in a generally tilted or inclined position relative to the assembly outlet 180 or relative to a bottom of the body member 160.

As is also shown in FIG. 11, the cleaning assembly 158 may include a hanger 164 disposed on a side thereof for hanging the cleaning assembly 158 over an edge of the water holding tank 142 of the toilet 140. Because the hanger 164 orients the cleaning assembly 158 in a tilted manner, the slot 182 is likewise preferably tilted so as to be in general alignment with a level of liquid remaining in the interior cavity 162 when the cleaning assembly 158 is hung from the hanger 164. As can also be seen in FIGS. 11–12, the cleaning assembly 158 includes a cap 166 which may be removably engagable via threads formed on the body member 160 and on the cap 166. In addition, a seal 168 may be disposed circumferentially around an inner portion of the cap 166 to seal the interior cavity 162.

It should be noted that the inclusion of the passageway 38 between the first and second reservoirs 24, 26 is functionally related to the positioning of the slot 182 above the assembly inlet 178 in the cleaning assembly 158. More specifically, the slot 182 is positioned such that during flushing of the toilet 140, siphoning action created thereby within the interior cavity 162 of the cleaning assembly 158 draws liquid out of the assembly outlet 180. At the same time, liquid enters the timer inlet 44 and initially accumulates within the timer body 12. A portion of liquid in the first reservoir 24 will pass through the passageway 38 and enter the second reservoir 26 at a relatively low flow rate. Such liquid will then be passed through the timer outlet 68 into the assembly inlet 178 and eventually be drawn out of the interior cavity 162 through the assembly outlet 180.

However, as the float reservoir 30 accumulates liquid which causes the float member 100 to rise, the valve lid 130 eventually closes off the drain tube 118 causing the timer body 12 to completely fill with liquid which substantially increases the flow rate out of the timer outlet 68. During this time, liquid is constantly being drawn through the interior cavity 162 of the cleaning assembly 158. Such liquid contains the cleaning agent 174 solution which is discharged out of the assembly outlet 180 into the overflow pipe 152 of the toilet 140. Near the end of the flushing cycle, siphoning action imposed on the interior cavity 162 by the flushing action draws any remaining liquid out of the timer body 12 and through the interior cavity 162 for discharges out of the assembly outlet 180.

The first and second partitions 34, 36 isolate the second reservoir 26 from the third and first reservoirs 28, 24 such that only liquid which is in the second reservoir 26 may be drawn out of the timer body 12 by the siphoning action during flushing. Liquid contained within the third reservoir 28 and the float reservoir 30 will drain slowly out of the bleed valve assembly 80 in a manner as was earlier mentioned. Any liquid remaining within the catch pan 56 will drain into the first reservoir 24 through the catch pan orifice 64. Liquid remaining within the first reservoir 24 will pass slowly through the passageway 38 and into the second reservoir 26. As the siphoning action comes to an end, the small portion of liquid passing from the first reservoir 24 to the second reservoir 26 flows through the timer outlet 68 and enters the timer inlet 44 and fills the cleaning assembly 158 up to the level of the slot 182.

Therefore, at the end of each flush cycle, a level of liquid remains within the interior cavity 162 at the level of the slot 182. In this manner, the assembly inlet 178 is always submerged in liquid. Likewise, because the assembly inlet 178 is connected to the timer outlet 68, the timer outlet 68 will also be submerged. Importantly, this scenario prevents the passage of chlorine gas or other gasses which may be generated by the cleaning agent 174 solution from passing back through the assembly inlet 178 and into the timer outlet 68. Gas entering the timer body 12 would otherwise escape though the check valve 50 located in an upper portion of the timer body 12. Such gas may produce an undesirable odor in the water holding tank 142 which may seep into the bathroom or other facility wherein the toilet 140 is located.

The operation of the time release system 10 will now be described with reference to FIGS. 1–12. When a user flushes the toilet 140 using the handle 146 shown in FIGS. 1–2, liquid (i.e., water) flows from the ball cock 148 shown in FIG. 2 passing through the refill tube 150 and entering the timer inlet 44. At the same time, the flushing of the toilet 140 results in opening of a flapper valve 154 shown in FIG. 2 as being disposed at a lower end 132 of the overflow pipe 152. Water within the water holding tank 142 flows out of the flapper valve 154 and is delivered to the toilet bowl 144. The liquid entering the timer inlet 44 flows into the timer body 12 and initially flows through the drain tube 118 with a minor portion of the liquid accumulating in the catch pan 56. As liquid flows from the catch pan 56 into the first reservoir 24, liquid will accumulates within the first reservoir 24. A potion of the liquid slowly passes through the passageway 38 into the second reservoir 26.

The liquid within the first reservoir 24 also eventually overflows the first partition 34 and enters the second partition 36. A portion of such liquid will exit the timer outlet 68 while the second reservoir 26 fills with liquid. As liquid fills the second reservoir 26 and overflows the second partition 36, the liquid fills the third reservoir 28. Ultimately, the liquid overflows the main interior wall 32 and enters the float reservoir 30 whereupon the float member 100 rises causing the float valve 106 to move from the open position 124 (wherein the float member 100 is shown in the lower position 122) to the closed position (wherein the valve lid 130 is placed in direct sealing engagement with the upper rim 120 of the drain tube 118).

In the closed position, liquid entering the timer inlet 44 fills the timer body 12 at a greatly increased rate. Eventually, the timer body 12 completely fills with liquid which causes an increase in pressure within the timer body 12. At this point, the timer outlet 68 flow rate is substantially equivalent to the timer inlet 44 flow rate. As the cleaning assembly 158 fills with the liquid from the timer body 12, a portion of the liquid drains to the overflow pipe 152 through the assembly outlet 180 via the connecting hose 156. When the cleaning assembly 158 fills with liquid, the liquid within the cleaning assembly 158 swirls under the water pressure and dissolves cleaning agent 174 contained within the interior cavity 162.

The solution of liquid and cleaning agent 174 then flows from the interior cavity 162 and is supplied to the overflow pipe 152 and into the toilet bowl 144. Importantly, such supply of the solution occurs toward the end of the flushing cycle. At this time, the flapper valve 154 closes and a tank float 184 in the the water holding tank 142 is gradually rotatably moved from its lower position 122 to an upper position with the rise of water in the water holding tank 142. During its movement to the upper position, liquid (i.e., water) continues to pass through the ball cock 148 and into the refill tube 150. When the float assembly 98 reaches its upper position, the flow of liquid through the ball cock 148 and into the timer inlet 44 is shut off.

Siphoning action, created by the draining of the toilet bowl 144, causes a major portion of liquid and cleaning agent 174 solution from the interior cavity 162 to be drained out of the assembly outlet 180. Due to the delay in the release of the liquid from the timer body 12, the solution only flows into the overflow pipe 152 and into the toilet bowl 144 at the very end of the flushing cycle. The solution flows over the main interior wall 32 of the toilet bowl 144 including the sides and rim thereof and remains within the toilet bowl 144 after flushing occurs. The minor portion of liquid remaining in the interior cavity 162 at a level of the slot 182 allows cleaning agent 174 to dissolve in preparation for the next flushing cycle. In addition, because the level of liquid in the interior cavity 162 is at a minimum water level 176 that is above the assembly inlet 178, any gas that is created by dissolving of the cleaning agent 174 is prevented from passing into the timer body 12 and out of the check valve 50.

At the end of the flushing cycle, the liquid remaining within the float reservoir 30 drains through the bleed valve assembly 80 in droplet formation in the manner as was earlier described. The drop in liquid level in the float reservoir 30 causes the float member 100 to move to the lower position 122 which moves the float vale to the open position 124 (i.e. the valve lid 130 is disengaged from the upper rim 120 of the drain tube 118) in preparation for the next flushing cycle. Likewise, liquid within the third reservoir 28 also drains out of the bleed valve assembly 80 in droplet formation. Any remaining liquid within the first reservoir 24 flows into the second reservoir 26 causing the timer outlet 68 and the assembly inlet 178 to become submerged with liquid and thereby preventing the transfer of gas from the cleaning assembly 158 to pass back into the timer body 12 where it may otherwise be released into the environment through the check valve 50.

Additional modifications and improvements of the present invention may also be apparent to those of ordinary skill in the art. Thus, the particular combination of parts described and illustrated herein is intended to represent only certain embodiments of the present invention, and is not intended to serve as limitations of alternative devices within the spirit and scope of the invention.

What is claimed is:

1. A hydraulic time release system for regulating the flow of liquid therethrough, comprising:

a timer body having a timer inlet for providing liquid to the timer body at a timer inlet flow rate and a timer outlet for discharging liquid from the timer body at a timer outlet flow rate, the timer body including a plurality of reservoirs being in at least partial fluid communication with one another;

wherein:

one of the reservoirs includes a drain tube disposed therewithin and having a lower end and an upper rim, the lower end opening to an exterior of the timer body, the upper rim being generally positioned under the timer inlet in spaced relation thereto; and a timer float assembly disposed within one of the reservoirs and being operatively connected to a float valve configured to be moveable between open and closed positions in response to variations in the reservoir liquid level corresponding to the flow of liquid therein into;

wherein:

the movement of the float valve to the open position results in a substantial portion of liquid entering the timer body at the timer inlet to pass through the drain tube and exit the timer body with a remaining portion of the liquid successively flowing to the reservoirs during which time the liquid exits the timer outlet at a flow rate that is substantially less than the timer inlet flow rate; and the movement of the float valve to the closed position resulting in the float valve blocking the flow of liquid into the drain tube causing the liquid to fill the timer body whereupon the timer outlet flow rate is substantially equivalent to the timer inlet flow rate.

2. The hydraulic time release system of claim 1 further comprising:

a catch pan;

wherein:

the timer body includes a first reservoir, a second reservoir, a third reservoir and a float reservoir;

the first reservoir having the catch pan disposed therewithin and through which the drain tube extends upwardly therethrough, the second reservoir being in at least partial fluid communication with the first reservoir and having the timer outlet disposed therein, the third reservoir being in at least partial fluid communication with the second reservoir, the float reservoir being in at least partial fluid communication with the first, second and third reservoirs;

the movement of the float valve to the open position resulting in the remaining portion of the liquid successively flowing from the catch pan into the first, second, third and float reservoirs during which time the liquid exits the timer outlet at a flow rate that is substantially less than the timer inlet flow rate.

3. The hydraulic time release system of claim 2 wherein the catch pan and the first, second, third and float reservoirs are sized and configured to provide a time delay of from about four seconds to about seven seconds measured from the time at which fluid enters the timer inlet to the time at which the timer inlet flow rate is substantially equivalent to the timer outlet flow rate.

4. The hydraulic time release system of claim 2 wherein:

the float member is reciprocative between lower and upper positions in response to variations in the float reservoir liquid level caused by the flow of liquid between the float reservoir and the first, second and third reservoirs;

the lower position corresponding to the closed position;

the upper position corresponding to the open position.

5. The hydraulic time release system of claim 4 wherein:

the drain tube includes an upper rim;

the timer body including a floor panel;

the float reservoir being separated from the first, second and third reservoirs by a main interior wall extending upwardly from the floor panel;

the timer body including a spaced pair of posts extending upwardly from a portion of the main interior wall that separates the float reservoir from the first reservoir;

the float member being connected to the float valve by a hinge arm pivotally supported on the pair of posts;

the float valve having a valve lid configured to be directly engageable to the upper rim when the float member is in the upper position.

6. The hydraulic time release system of claim 1 wherein:

the timer inlet includes an inlet divider comprising first and second inlet ports formed in the timer body;

the first inlet port being larger in size than the second inlet port and being generally aligned with the drain tube such that the substantial portion of liquid entering the timer body passes through the drain tube;

the second inlet port being configured to direct the remaining portion of liquid into the reservoirs.

7. The hydraulic time release system of claim 1 wherein the timer inlet is configured to be fluidly connectable to a ball cock of a toilet.

8. The hydraulic time release system of claim 7 wherein the timer outlet is configured to be fluidly connectable to a cleaning assembly having a body member with a sealed interior cavity formed therein for receiving a cleaning agent, the cleaning system being configured to release the cleaning agent into a toilet bowl of the toilet.

9. The hydraulic time release system of claim 8 wherein the cleaning assembly includes:

an assembly inlet in fluid communication with the interior cavity and connectable to the timer outlet;

an assembly outlet in fluid communication with the interior cavity and connectable to an overflow pipe of the toilet; and the body member including a slot formed therein adjacent to the assembly outlet and through which liquid may pass from the interior cavity to the assembly outlet;

wherein the slot is positioned at a higher level than that of the assembly inlet such that a level of liquid within the interior cavity remains above the assembly inlet to prevent gas within the interior cavity from passing through the assembly inlet and entering the timer body due to siphoning action created by flushing of the toilet.

10. The hydraulic time release system of claim 9 wherein:

the second reservoir is separated from the first reservoir by a first partition;

the third reservoir being separated from the second reservoir by a second partition;

the first and second partitions being configured to prevent draining of the second reservoir during siphoning action created by emptying of the interior cavity during the release of the cleaning agent into the toilet bowl.

11. The hydraulic time release system of claim 10 wherein:

the first partition includes a passageway formed at a lower portion thereof for allowing fluid communication between the first and second reservoirs;

the passageway being sized and configured such that the rate at which liquid passes from the first reservoir to the second reservoir is less than the rate at which liquid exits the assembly outlet during flushing of the toilet to allow a level of liquid within the interior cavity to remain above the assembly inlet after flushing of the toilet.

12. The hydraulic time release system of claim 11 wherein:

the timer body includes a floor panel;

the passageway is configured as a bore extending at least partially through the floor panel, the bore being generally located below the first partition.

13. The hydraulic time release system of claim 1 wherein the float valve includes a valve lid having a gasket disposed on an underside thereof for sealing the valve lid to the upper rim.

14. The hydraulic time release system of claim 1 wherein the timer body includes a lower body portion and an upper body portion collectively enclosing a body chamber, the upper body portion including a check valve disposed therewithin.

15. The hydraulic time release system of claim 14 wherein the check valve is configured to prevent liquid and gas from flowing out of the body chamber, the check valve including at least one opening to an exterior of the body chamber and including a ball for opening and closing the opening.

16. The hydraulic time release system of claim 1 wherein the timer body includes a bleed valve assembly for draining the timer body.

17. The hydraulic time release system of claim 16 wherein:

the timer body includes a floor panel having a bleed valve shoulder extending downwardly from the floor panel;

the bleed valve assembly including a valve insert configured to be connectable to the bleed valve shoulder;

the valve insert having an insert web extending across an insert flange with an insert boss formed on an upper surface of the insert web, the insert boss having an insert port extending therethrough, the valve insert being configured such that the insert boss is disposed in spaced relation to the floor panel.

18. The hydraulic time release system of claim 17 wherein:

the movement of the float valve to the closed position and subsequent filling of the timer body results in an increase in liquid pressure therewithin relative to the liquid pressure when the float valve is in the open position;

the insert port, bleed valve shoulder and insert flange being sized and configured to cause the liquid to stream through the insert port when the float valve is in the closed position and to promote liquid droplet formation when the float valve is in the open position.

19. The hydraulic time release system of claim 17 wherein the insert web includes at least one groove formed in a lower surface thereof and generally extending between opposing sides of the insert flange and being configured to promote droplet formation when the float valve is in the open position.

20. The hydraulic time release system of claim 17 wherein the bleed valve shoulder is annularly shaped and the insert flange is configured to be complementary thereto such that an outer surface of the valve insert is engageable to an inner surface of the bleed valve shoulder.

21. A delayed release cleaning system for providing a delayed release of cleaning agent into a toilet bowl of a toilet, the cleaning system comprising:

a timer body having a timer inlet for providing liquid to the timer body at a timer inlet flow rate and a timer outlet for discharging liquid from the timer body at a timer outlet flow rate, the timer body including a plurality of reservoirs being in at least partial fluid communication with one another;

wherein:

one of the reservoirs includes a drain tube disposed therewithin and having a lower end and an upper rim, the lower end opening to an exterior of the timer body, the upper rim being generally positioned under the timer inlet in spaced relation thereto; and a timer float assembly disposed within one of the reservoirs and being operatively connected to a float valve configured to be moveable between open and closed positions in response to variations in the reservoir liquid level corresponding to the flow of liquid thereinto;

wherein:

the movement of the float valve to the open position results in a substantial portion of liquid entering the timer body at the timer inlet to pass through the drain tube and exit the timer body with a remaining portion of the liquid successively flowing to the reservoirs during which time the liquid exits the timer outlet at a flow rate that is substantially less than the timer inlet flow rate; and the movement of the float valve to the closed position resulting in the float valve blocking the flow of liquid into the drain tube causing the liquid to fill the timer body whereupon the timer outlet flow rate is substantially equivalent to the timer inlet flow rate; and a cleaning assembly, including:

a body member having a sealed interior cavity for receiving a cleaning agent;

an assembly inlet in fluid communication with the interior cavity and connectable to the timer outlet; and an assembly outlet in fluid communication with the interior cavity and connectable to an overflow pipe of the toilet;

the cleaning assembly being configured such that a level of liquid within the sealed interior cavity remains at a level sufficient to slowly dissolve the cleaning agent;

wherein the assembly outlet includes a slot formed in the body member and positioned at a higher level than that of the assembly inlet such that a level of liquid within the interior cavity remains above the assembly inlet to prevent gas within the interior cavity from discharging thereout due to siphoning action created by flushing of the toilet.

22. The hydraulic time release system of claim 21 further comprising:

a catch pan;

wherein:

the timer body includes a first reservoir, a second reservoir, a third reservoir and a float reservoir;

the first reservoir having the catch pan disposed therewithin and through which the drain tube extends upwardly therethrough, the second reservoir being in at least partial fluid communication with the first reservoir and having the timer outlet disposed therein, the third reservoir being in at least partial fluid communication with the second reservoir, the float reservoir being in at least partial fluid communication with the first, second and third reservoirs;

the movement of the float valve to the open position resulting in the remaining portion of the liquid successively flowing from the catch pan into the first, second, third and float reservoirs during which time the liquid exits the timer outlet at a flow rate that is substantially less than the timer inlet flow rate.

23. The hydraulic time release system of claim 22 wherein:

the second reservoir is separated from the first reservoir by a first partition;

the third reservoir being separated from the second reservoir by a second partition;

the first and second partitions being configured to prevent draining of the second reservoir during siphoning action created by emptying of the interior cavity during the release of the cleaning agent into the toilet bowl.

24. The hydraulic time release system of claim 23 wherein:

the first partition includes a passageway formed at a lower portion thereof for allowing fluid communication between the first and second reservoirs;

the passageway being sized and configured such that the rate at which liquid passes from the first reservoir to the second reservoir is less than the rate at which liquid exits the assembly outlet during flushing of the toilet to allow liquid to fill the interior cavity up to the slot to remain above the assembly inlet to prevent gas within the interior cavity from discharging thereout after flushing of the toilet.

25. The hydraulic time release system of claim 22 wherein the catch pan and the first, second, third and float reservoirs are sized and configured to provide a time delay of from about four seconds to about seven seconds measured from the time at which fluid enters the timer inlet to the time at which the timer inlet flow rate is substantially equivalent to the timer outlet flow rate.

26. The hydraulic time release system of claim 22 wherein:

the float member is reciprocative between lower and upper positions in response to variations in the float reservoir liquid level caused by the flow of liquid between the float reservoir and the first, second and third reservoirs;

the lower position corresponding to the closed position;

the upper position corresponding to the open position.

27. The hydraulic time release system of claim 26 wherein:

the drain tube includes an upper rim;

the timer body includes a floor panel;

the float reservoir being separated from the first, second and third reservoirs by a main interior wall extending upwardly from the floor panel;

the timer body including a spaced pair of posts extending upwardly from a portion of the main interior wall that separates the float reservoir from the first reservoir;

the float member being connected to the float valve by a hinge arm pivotally supported on the pair of posts;

the float valve having a valve lid configured to be directly engageable to the upper rim when the float member is in the upper position.

28. The hydraulic time release system of claim 21 wherein the cleaning assembly includes a cap removably attached to the body member to form a sealed space at an upper portion of an interior cavity of the body member.

29. The hydraulic time release system of claim 21 wherein the timer inlet is configured to be fluidly connectable to a ball cock of the toilet.

30. The hydraulic time release system of claim 21 wherein the timer body includes a lower body portion and an upper body portion collectively enclosing a body chamber, the upper body portion including a check valve disposed therewithin.

31. The hydraulic time release system of claim 30 wherein the check valve is configured to prevent liquid and gas from flowing out of the body chamber, the check valve including at least one opening to an exterior of the body chamber and including a ball for opening and closing the opening.

32. The hydraulic time release system of claim 21 wherein the timer body includes a bleed valve assembly for draining the timer body.

33. The hydraulic time release system of claim 32 wherein:

the timer body includes a floor panel having a bleed valve shoulder extending downwardly from the floor panel;

the bleed valve assembly including a valve insert configured to be connectable to the bleed valve shoulder;

the valve insert having an insert web extending across an insert flange with an insert boss formed on an upper surface of the insert web, the insert boss having an insert port extending therethrough, the valve insert being configured such that the insert boss is disposed in spaced relation to the floor panel.

34. The hydraulic time release system of claim 33 wherein:

the movement of the float valve to the closed position and subsequent filling of the timer body results in an increase in liquid pressure therewithin relative to the liquid pressure when the float valve is in the open position;

the insert port, bleed valve shoulder and insert flange being sized and configured to cause the liquid to stream through the insert port when the float valve is in the closed position and to promote liquid droplet formation when the float valve is in the open position.

35. The hydraulic time release system of claim 33 wherein the insert web includes at least one groove formed in a lower surface thereof and generally extending between opposing sides of the insert flange and being configured to promote droplet formation when the float valve is in the open position.

36. The hydraulic time release system of claim 33 wherein the bleed valve shoulder is annularly shaped and the insert flange is configured to be complementary thereto such that an outer surface of the valve insert is engageable to an inner surface of the bleed valve shoulder.

* * * * *